US010610730B2

(12) United States Patent
Andersen

(10) Patent No.: US 10,610,730 B2
(45) Date of Patent: Apr. 7, 2020

(54) EXERCISE DEVICE TO BE PLACED ON A USER'S BACK DURING PUSH-UPS

(71) Applicant: Lance Andersen, Sioux Falls, SD (US)

(72) Inventor: Lance Andersen, Sioux Falls, SD (US)

( * ) Notice: Subject to any disclaimer, the term of this patent is extended or adjusted under 35 U.S.C. 154(b) by 38 days.

(21) Appl. No.: 15/954,619

(22) Filed: Apr. 17, 2018

(65) Prior Publication Data

US 2019/0314678 A1 Oct. 17, 2019

(51) Int. Cl.
*A63B 23/12* (2006.01)
*A63B 21/00* (2006.01)
*A63B 21/065* (2006.01)

(52) U.S. Cl.
CPC ..... *A63B 23/1236* (2013.01); *A63B 21/065* (2013.01); *A63B 21/4039* (2015.10)

(58) Field of Classification Search
CPC ..... A63B 23/1236; A63B 21/065; A63B 21/4039
See application file for complete search history.

(56) References Cited

U.S. PATENT DOCUMENTS 3,679,107 A * 7/1972 Perrine ..... A45F 3/14 224/201
4,714,247 A * 12/1987 Gerstung ..... A63B 23/1209 482/105
4,944,509 A * 7/1990 Snider ..... A63B 21/065 482/105
4,948,122 A * 8/1990 Andrews, Sr. ..... A63B 21/065 482/105
4,986,536 A * 1/1991 Zane ..... A63B 21/4005 224/266
5,167,600 A * 12/1992 Baird ..... A63B 21/065 482/100
5,211,615 A * 5/1993 Sides ..... A63B 21/065 482/105
5,472,398 A * 12/1995 Silverman ..... A63B 21/4005 482/105
5,957,818 A * 9/1999 Betournay ..... A63B 21/065 482/105
6,652,431 B1 * 11/2003 Mattox ..... A63B 21/0004 224/201
D780,858 S * 3/2017 Pfaff ..... D21/683
D797,868 S * 9/2017 Thomas ..... D21/683
2005/0014614 A1 * 1/2005 Ahman ..... A63B 21/065 482/105
2006/0229173 A1 * 10/2006 Foley ..... A63B 21/06 482/105
2011/0183819 A1 * 7/2011 Pharoe ..... A63B 21/0552 482/105
2012/0028768 A1 * 2/2012 McClellan Fortner ..... A63B 21/00072 482/105

(Continued)

*Primary Examiner* — Andrew S Lo
(74) *Attorney, Agent, or Firm* — The Iwashko Law Firm, PLLC; Lev Ivan Gabriel Iwashko

(57) ABSTRACT

An exercise device to be worn on a back of a user performing push-ups, the exercise device including a frame, a neck support to extend from the frame in a first direction, a back pad to extend from the frame in a second direction, a first bar to curvedly extend from the neck support in a third direction, a second bar to curvedly extend from the neck support in a fourth direction, and a weight support rod to extend perpendicularly away from the back pad in a fifth direction.

3 Claims, 3 Drawing Sheets

(56) References Cited

U.S. PATENT DOCUMENTS

| | | | | |
|---|---|---|---|---|
| 2012/0151656 | A1* | 6/2012 | Irwin | A63B 21/065 2/102 |
| 2014/0349819 | A1* | 11/2014 | McClellan | A63B 21/00072 482/105 |
| 2014/0357460 | A1* | 12/2014 | Sorace | A63B 23/1236 482/141 |
| 2015/0306454 | A1* | 10/2015 | Winbush | A63B 23/18 482/13 |
| 2015/0335938 | A1* | 11/2015 | Seen | A63B 21/072 482/105 |
| 2017/0326403 | A1* | 11/2017 | Castaneda | A63B 23/02 |
| 2018/0021662 | A1* | 1/2018 | Carpinelli | A63B 21/4005 482/104 |
| 2018/0093124 | A1* | 4/2018 | Roybal | A63B 21/065 |

* cited by examiner

EXERCISE DEVICE TO BE PLACED ON A USER'S BACK DURING PUSH-UPS

BACKGROUND

1. Field

The present general inventive concept relates generally to an exercise device, and particularly, to an exercise device to be placed upon a user's back during push-ups.

2. Description of the Related Art

People who routinely work out eventually reach a point where they need more creative ways to improve their core. Some incorporate additional machinery or retreat to manual workouts such as doing push-ups on the floor, but more variety can supercharge exercises and throw a whole range of new muscles into the mix.

Therefore, there is a need for an exercise device to enhance push-ups.

SUMMARY

The present general inventive concept provides an exercise device to be placed upon a user's back during push-ups.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an exercise device to be worn on a back of a user performing push-ups, the exercise device including a frame, a neck support to extend from the frame in a first direction, a back pad to extend from the frame in a second direction, a first bar to curvedly extend from the neck support in a third direction, a second bar to curvedly extend from the neck support in a fourth direction, and a weight support rod to extend perpendicularly away from the back pad in a fifth direction.

The exercise device may further include at least one removable weight to receive the weight support rod in a center aperture of the at least one removable weight, such that a bottom surface of the at least one removable weight contacts a top portion of the back pad.

The first bar may include a first handle disposed at an end portion of the first bar and the second bar comprises a second handle disposed at an end portion of the second bar.

The neck support may include a neck support pad to provide a cushion for a neck of the user.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
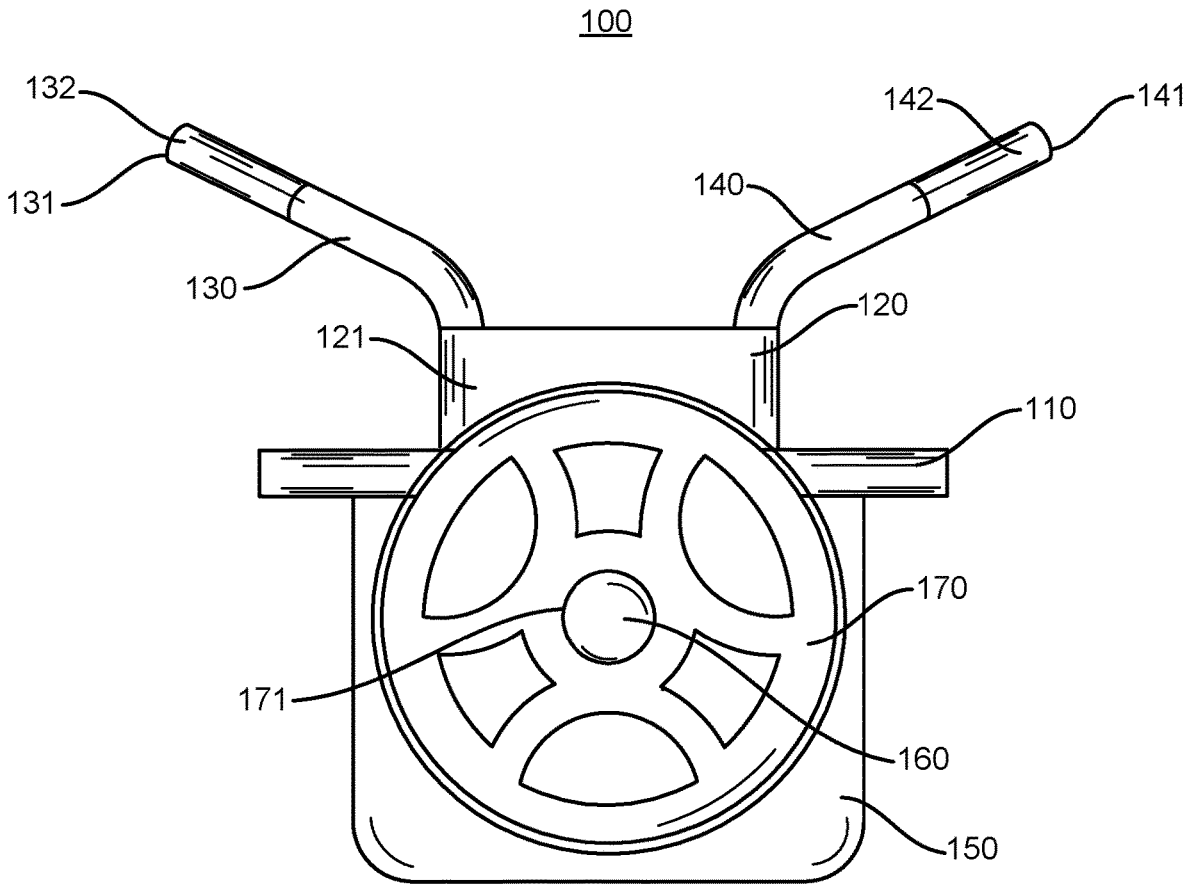
FIG. 1 illustrates an exercise device, according to an exemplary embodiment of the present general inventive concept.

FIG. 1 illustrates an exercise device 100, according to an exemplary embodiment of the present general inventive concept.

The exercise device 100 may be constructed from wood, metal, plastic, rubber, or any other material known to one of ordinary skill in the art.

Figure 2:
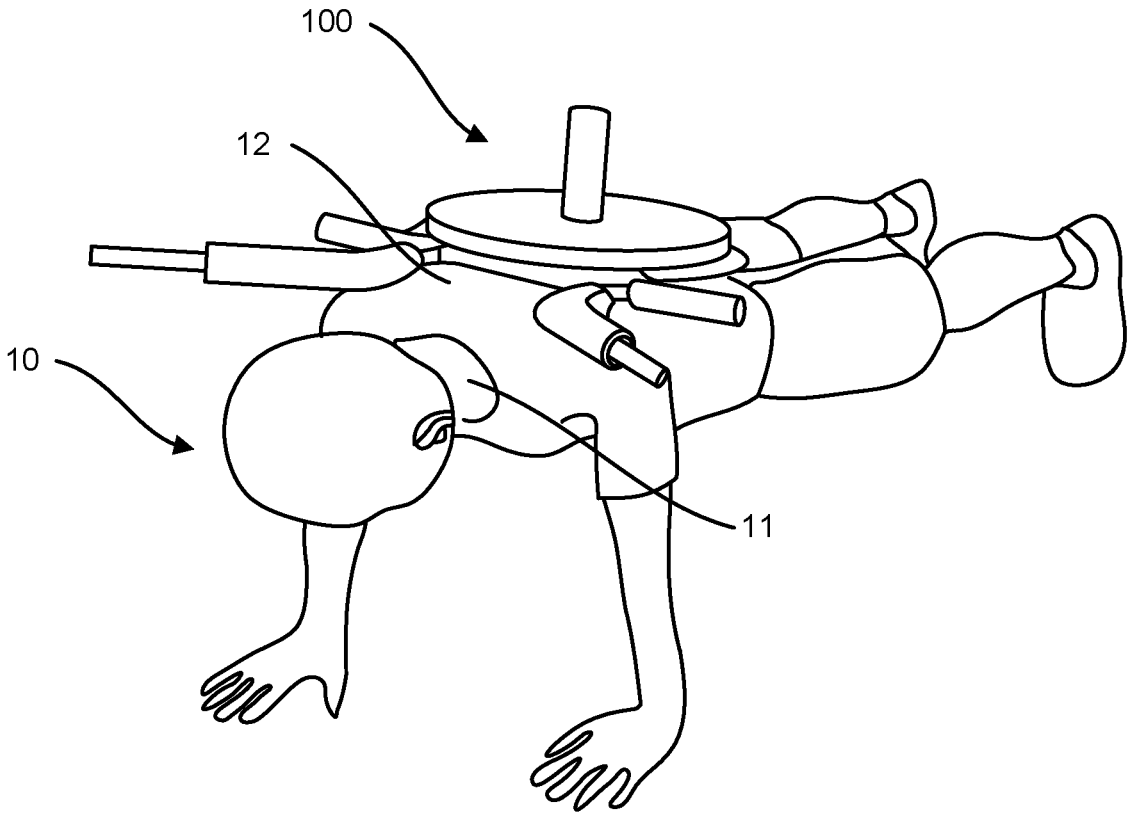
FIG. 2 illustrates the exercise device worn by a user as the user performs push-ups, according to an exemplary embodiment of the present general inventive concept.

FIG. 2 illustrates the exercise device 100 worn by a user 10 as the user 10 performs push-ups, according to an exemplary embodiment of the present general inventive concept.

The exercise device 100 may include a frame 110, a neck support 120, a first bar 130, a second bar 140, a back pad 150, a weight support rod 160, and at least one removable weight 170.

The frame 110 may be dispersed throughout an entirety of the exercise device 100 to support the other components of the exercise device 100, or alternatively, may be just a lateral rod/pipe, as illustrated in FIG. 1.

The neck support 120 may extend laterally from a portion of the frame 110. The neck support 120 may include a neck support pad 121 to provide a cushion for a neck 11 of the user 10 when the user 10 wears the exercise device 100.

The first bar 130 may extend from the neck support 120, and may be connected to the frame 110. The first bar 130 may be constructed from metal, and may have somewhat of an "L" shape, such that an end 131 of the first bar 130 extends away from the neck support 120.

The first bar 130 may include a first handle 132 disposed at the end 131 of the first bar 130, such that the user 10 may easily grip the first handle 132. The first handle 132 may be constructed from rubber, tape, or any other material that provides a decent grip for the user 10.

The second bar 140 may also extend from the neck support 120, and may be connected to the frame 110. The second bar 140 may be constructed from metal, and may have somewhat of an "L" shape, such that an end 141 of the second bar 140 extends away from the neck support 120 in a direction opposite from a direction that the end 131 of the first bar 130 extends.

The second bar 140 may include a second handle 142 disposed at the end 141 of the second bar 140, such that the user 10 may easily grip the handle second 142. The second handle 142 may be constructed from rubber, tape, or any other material that provides a decent grip for the user 10.

The back pad 150 may extend from a portion of the frame 110 in a direction opposite of an extending direction of the neck support 120. The back pad 150 may provide a cushion for the user 10, such that a back 12 of the user contacts the back pad 150.

The weight support rod 160 may extend perpendicularly away from the back pad 150, and may be shaped and designed as a rod to hold the at least one removable weight 170. The at least one removable weight 170 may be provided in plurality, such that a center aperture 171 of each of the at least one removable weights 170 receives the weight support rod 160.

In other words, the at least one removable weight 170 may receive the weight support rod 160 in the center aperture 171 of the at least one removable weight 170, such that a bottom surface of the at least one removable weight 170 contacts a top portion of the back pad 150.

Accordingly, it is to be noted that the neck support 120 may extend from the frame 110 in a first direction, the back pad 150 may extend from the frame 110 in a second direction, the first rod 130 may curvedly extend from the neck support 120 in a third direction, the second rod 140 may curvedly extend from the neck support 120 in a fourth direction, and the weight support rod 160 may extend perpendicularly from the back pad 150 in a fifth direction.

As such, as illustrated in FIG. 2, the user 10 may wear the exercise device 100 comfortably while performing push-ups.

Figure 3:
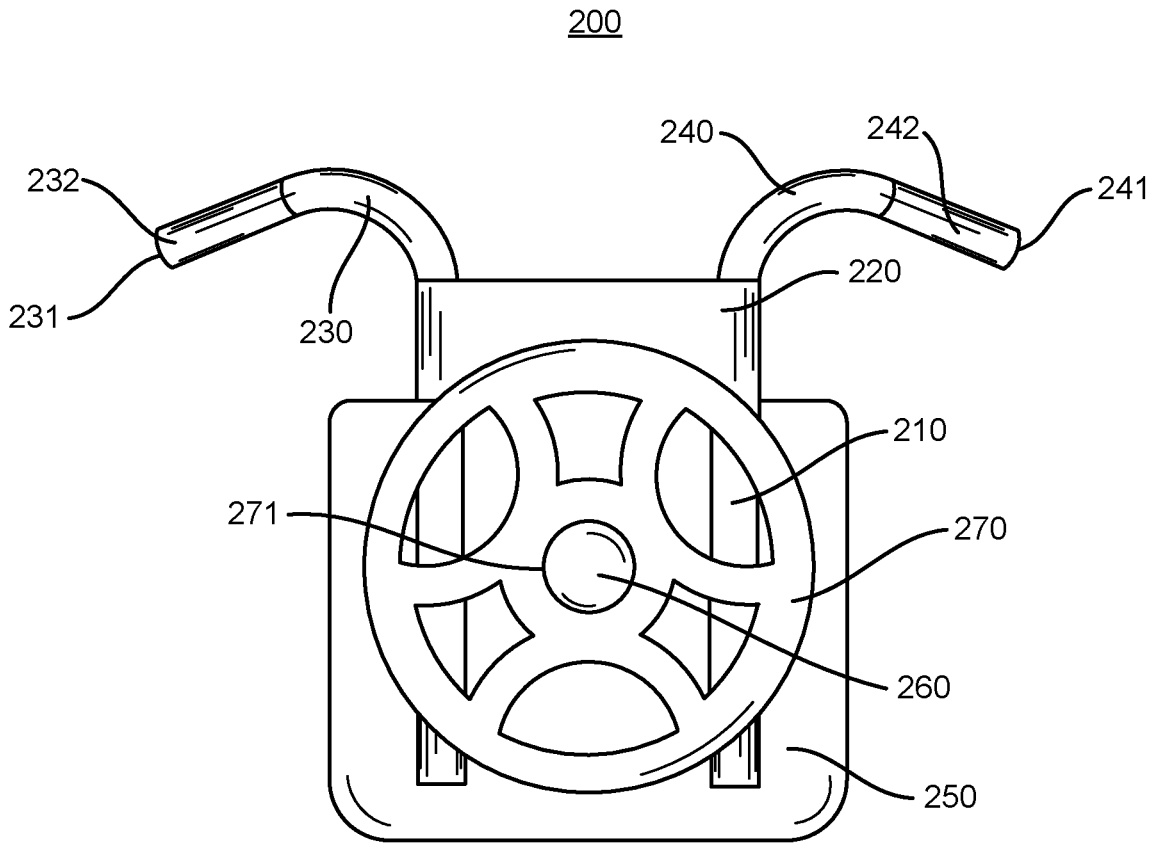
FIG. 3 illustrates an exercise device, according to another exemplary embodiment of the present general inventive concept.

FIG. 3 illustrates an exercise device 200, according to another exemplary embodiment of the present general inventive concept.

The exercise device 200 may include a frame 210, a neck support 220, a first bar 230, a second bar 240, a back pad 250, a weight support rod 260, and at least one removable weight 270.

The frame 210 may be dispersed throughout an entirety of the exercise device 100 to support the other components of the exercise device 100, or alternatively, may be just a plurality of longitudinal rods/pipes, as illustrated in FIG. 3.

The neck support 220 may extend longitudinally from a portion of the frame 210. The neck support 220 may include a neck support pad 221 to provide a cushion for a neck 11 of the user 10 when the user 10 wears the exercise device 200.

The first bar 230 may extend from the neck support 220, and may be connected to the frame 210. The first bar 230 may be constructed from metal, and may have somewhat of an open "V" shape, such that an end 231 of the first bar 230 extends away from the neck support 220.

The first bar 230 may include a first handle 232 disposed at the end 231 of the first bar 230, such that the user 10 may easily grip the first handle 232. The first handle 232 may be constructed from rubber, tape, or any other material that provides a decent grip for the user 10.

The second bar 240 may also extend from the neck support 220, and may be connected to the frame 210. The second bar 240 may be constructed from metal, and may have somewhat of an open "V" shape, such that an end 241 of the second bar 240 extends away from the neck support 220 in a direction opposite from a direction that the end 231 of the first bar 230 extends.

The second bar 240 may include a second handle 242 disposed at the end 241 of the second bar 240, such that the user 10 may easily grip the handle second 242. The second handle 242 may be constructed from rubber, tape, or any other material that provides a decent grip for the user 10.

The back pad 250 may be disposed above or below the frame 210 in a direction opposite of an extending direction of the neck support 220. The back pad 250 may provide a cushion for the user 10, such that a back 12 of the user contacts the back pad 250.

The weight support rod 260 may extend perpendicularly away from the back pad 250, and may be shaped and designed as a rod to hold the at least one removable weight 270. The at least one removable weight 270 may be provided in plurality, such that a center aperture 271 of each of the at least one removable weights 270 receives the weight support rod 260.

In other words, the at least one removable weight 270 may receive the weight support rod 260 in the center aperture 271 of the at least one removable weight 270, such that a bottom surface of the at least one removable weight 270 contacts a top portion of the back pad 250.

Accordingly, it is to be noted that the neck support 220 may extend from the frame 210 in a first direction, the back pad 250 may extend from the frame 210 in a second direction, the first rod 230 may curvedly extend from the neck support 220 in a third direction, the second rod 240 may curvedly extend from the neck support 220 in a fourth direction, and the weight support rod 260 may extend perpendicularly from the back pad 250 in a fifth direction or the second direction.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An exercise device configured to be worn on a back of a user performing push-ups, the exercise device comprising:

a frame comprising a lateral rod;

a neck support coupled to the frame and extending away from a first side of the frame in a first direction, the neck support including a neck support pad to provide cushion for the user's neck when the exercise device is worn;

a back pad configured to contact the user's back and coupled to the frame and extending away from a second side of the frame in a second direction, such that the frame is positioned in between the neck support and the back pad, wherein the frame extends beyond lateral sides of the neck support and the neck pad;

a first bar to curvedly extend away from a top end of the neck support in a third direction;

a second bar to curvedly extend away from the top end of neck support in a fourth direction, wherein the neck support spans a distance between the first bar and the second bar; and a weight support rod coupled to and extending perpendicularly away from the back pad in a fifth direction, wherein the first, second, third, fourth, and fifth directions are different from each other.

2. The exercise device of claim 1, further comprising:

at least one removable weight to receive the weight support rod in a center aperture of the at least one removable weight, such that a bottom surface of the at least one removable weight contacts a top portion of the back pad.

3. The exercise device of claim 1, wherein the first bar comprises a first handle disposed at an end portion of the first bar and the second bar comprises a second handle disposed at an end portion of the second bar.

* * * * *